United States Patent [19]

Edwards

[11] Patent Number: 4,887,564

[45] Date of Patent: Dec. 19, 1989

[54] VALVE ACTUATION SYSTEM FOR DESMODROMIC INTERNAL COMBUSTION ENGINES

[76] Inventor: James R. Edwards, 4871 W. Howard, Ontario, Calif. 91761

[21] Appl. No.: 335,442

[22] Filed: Apr. 10, 1989

[51] Int. Cl.[4] ..... F01L 1/30

[52] U.S. Cl. ..... 123/90.25

[58] Field of Search ..... 123/90.24, 90.25, 90.39, 123/90.41

[56] References Cited

U.S. PATENT DOCUMENTS

| | | | |
|---|---|---|---|
| 2,832,327 | 4/1958 | Lorenz | 123/90.24 |
| 3,254,637 | 6/1966 | Durham | 123/90.25 |
| 3,430,614 | 3/1969 | Meacham | 123/90.24 |
| 4,576,128 | 3/1986 | Kenichi | 123/90.39 |
| 4,805,568 | 2/1989 | Springer et al. | 123/90.25 |

*Primary Examiner*—Charles J. Myhre
*Assistant Examiner*—Weilun Lo
*Attorney, Agent, or Firm*—Edgar W. Averill, Jr.

[57] ABSTRACT

An improved internal combustion engine of the desmodromic type having a novel connection between the valve stem and the rocker arm assembly. The connection includes a shell which captures a pin which has an enlarged opening which surrounds the valve stem. As the valve end of the rocker arm assembly moves through an arcuate motion, the pin within the shell slides within the shell which, in turn, is tightly affixed to a valve stem. The valve is forced to close either by a spring or a second cam.

12 Claims, 2 Drawing Sheets

VALVE ACTUATION SYSTEM FOR DESMODROMIC INTERNAL COMBUSTION ENGINES

BACKGROUND OF THE DISCLOSURE

The field of the invention is internal combustion engines, and the engine relates more particularly to internal combustion engines of the desmodromic type. Such engines utilize a valve which closes more rapidly and more positively than caused by the typical valve spring positioned about the valve stem.

A factor which limits the quickness of an engine is the delay in closing the valve caused by a combination of inertia and the relative weakness of the valve spring resulting from the limitations in size brought about by its positioning about the valve stem. Desmodromic engines have been developed and several of these engines are disclosed in U.S. Pat. Nos. 3,610,218; 3,254,637; 1,541,081; 2,814,283; 1,408,781; 1,309,339; 1,238,263; 1,671,973; 1,185,516; 1,503,384; and Italian Patent No. 563,164. Many of these engines are of an early design and not capable of the high rpms required by today's automobile racing engines.

An improved desmodromic design is shown in applicant's U.S. Pat. No. 4,805,568 which drives the valve through a swinging movement.

SUMMARY OF THE INVENTION

It is an object of the present invention to provide an internal combustion engine which has a valve which is forced to close more quickly than conventional engines.

The present invention is for an improved internal combustion engine of the desmodromic type having an engine block with cylinders, a head held to the block and a plurality of intake valves and exhaust valves. A pivoted rocker arm assembly having a valve end for each valve and a second end at the opposite end of the rocker arm assembly is held to the engine block. The rocker arm assembly is attachable to a valve stem at its valve end, and a cam shaft with cam lobes is connected to the rocker arm assembly to pivot it about its pivot point, and means are provided to return the rocker arm assembly to its original position. The improvement of the present invention comprises a valve to rocker arm assembly connection including a lower stop on each valve stem and a shell member. The shell member has a generally horizontal, hollow inner chamber open at each end and a lower exterior contact surface abutting the lower stop of the valve stem. The shell member has two generally vertically aligned openings through which the valve stem passes, and the shell member has an upper exterior contact surface and an upper and a lower bearing surface on the inner surface thereof. A generally horizontal pin member, having a bearing at each end held by the valve end of the rocker arm assembly, is held within the shell member. The pin member has a generally vertical opening which is larger than the valve stem and surrounds the valve stem. The pin member has an upper bearing surface adjacent the upper bearing surface of the shell member, and a lower bearing surface is adjacent the lower bearing surface of the shell member. Means are provided for tightening the valve stem onto the upper exterior contact surface of the shell member to securely hold the shell member onto the valve stem, whereby the valve stem can move vertically while the point of connection of the valve stem on the rocker arm assembly moves in arcuate manner by the sliding of the shell member over the pin member. The rocker arm assembly may be driven toward a position to close the valve by the contact of a helical spring at the second end of the rocker arm assembly or by a second cam shaft with cam lobes to force the rocker arm in a position to close the valve.

DESCRIPTION OF THE PREFERRED EMBODIMENTS

Figure 1:
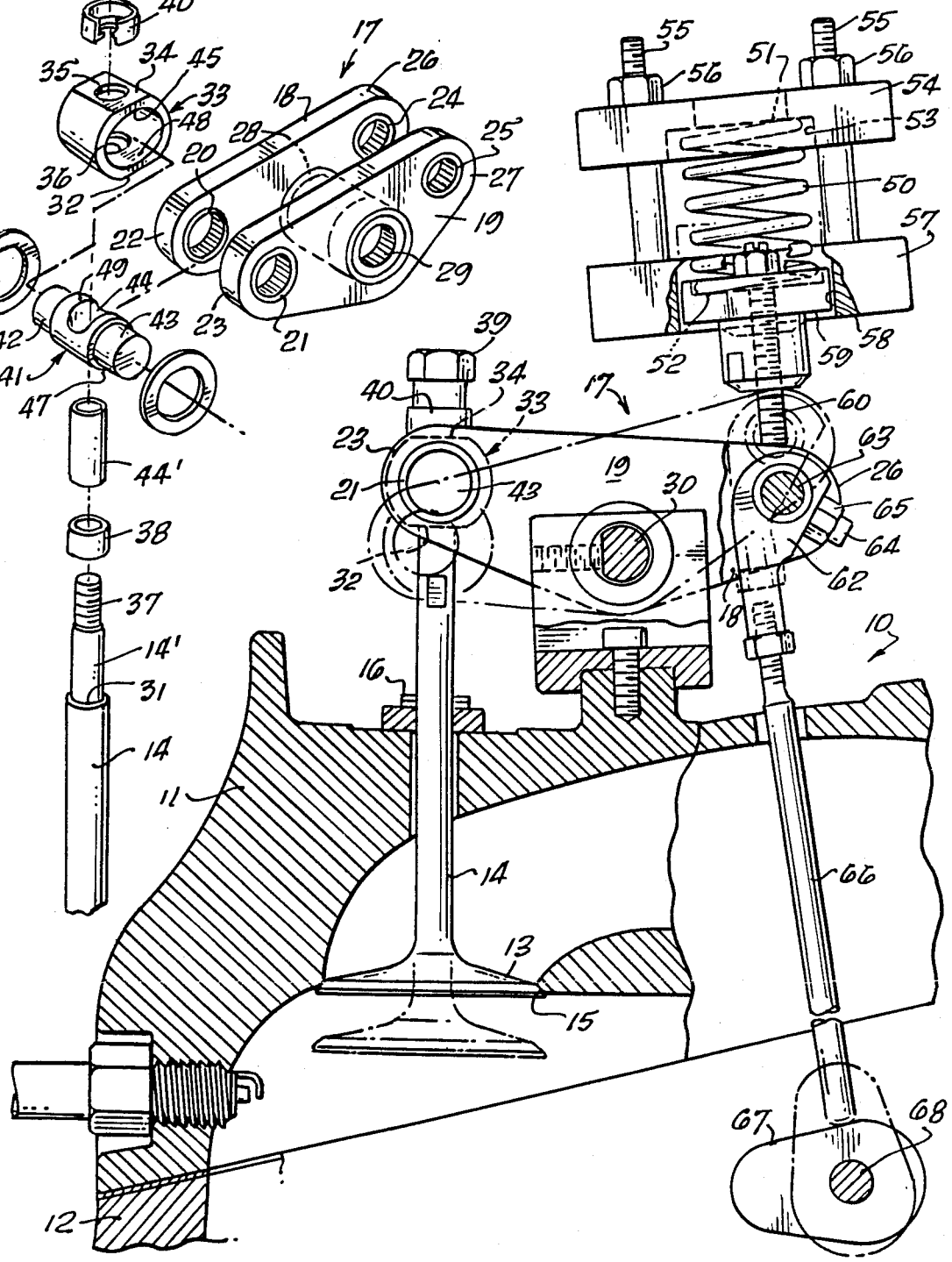
FIG. 1 is a side view partly in cross section showing the valve rocker arm assembly and cam shaft of the desmodromic engine of the present invention.

A portion of the improved internal combustion engine 10 is shown in cross-sectional view in FIG. 1. Engine 10 includes a head 11 and an engine block 12. A valve 13 has a valve stem 14 which moves the valve 13 into contact with a valve seat 15 in a conventional manner. A conventional oil seal 16 is affixed to head 11, and valve stem 14 oscillates about its longitudinal axis by the rocking of a rocker arm assembly 17. Rocker arm assembly 17 has a pair of rockers 18 and 19 (shown in FIG. 2) which have bearings 20 and 21 at their valve ends 22 and 23. Bearings 24 and 25 are located near the second ends 26 and 27. Each rocker has a central bearing 28 and 29 which surround a shaft 30 which comprises the pivot point of the rocker arm assembly.

Figure 2:
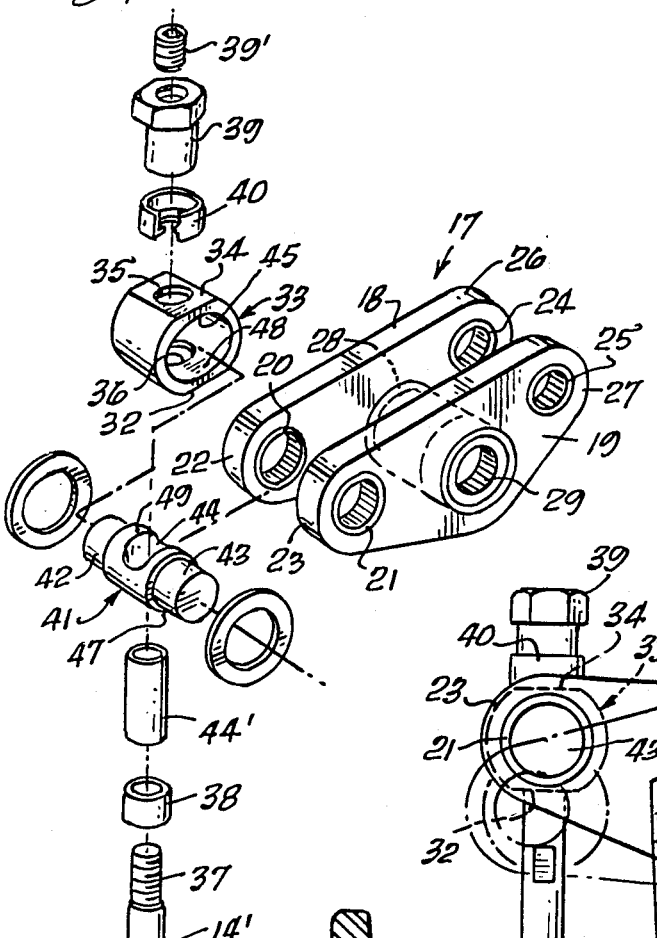
FIG. 2 is an exploded perspective view of the connection assembly between the rocker arm assembly and the valve stem.

The means for interconnecting the rocker arm assembly to the valve stem is shown best in FIG. 2 where it can be seen that valve stem 14 has a lower stop 31 which contacts the base of ring 38. The top of ring 38 supports both the lower exterior contact surface 32 of a shell member 33 and sleeve 44'. Shell member 33 also has an upper exterior contact surface 34 and a pair of openings 35 and 36 which surround sleeve 44' which, in turn, surrounds the upper portion of valve stem 14. A nut 39 is held in a cup 40, and both of these are tightened onto threaded portion 37 and contact the upper exterior contact surface 34 to tightly secure shell member 33 to valve stem 14. A set screw 39' holds nut 39 in place. A generally horizontal pin member 41 has a pair of bearings 42 and 43 and an enlarged opening 44. Enlarged opening 44 holds a sleeve 44, which tightly fits over stopped portion 14' of valve stem 14 but is free to move somewhat in enlarged opening 44. Bearings 42 and 43 fit into bearings 20 and 21, and the upper bearing surface 49 of pin member 41 contacts the upper bearing surface 45 of shell member 33. Similarly, lower bearing surface 47 contacts lower bearing surface 48 of shell member 33. The outside diameter of pin member 41 is only slightly smaller than the distance between the upper bearing surface 45 and the lower bearing surface 48.

Figure 3:
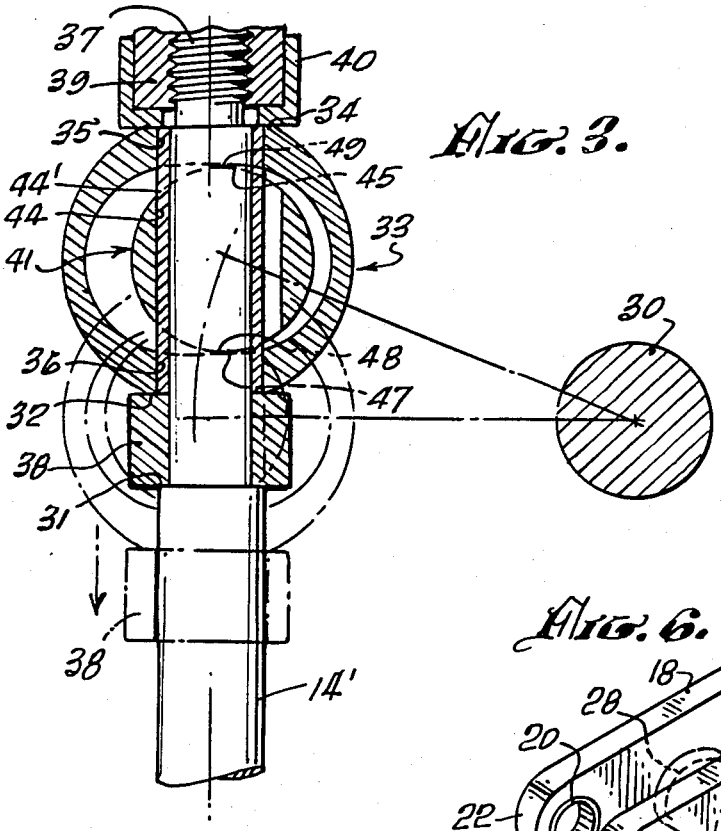
FIG. 3 is a diagrammatic view showing the interconnection of the valve stem with the rocker arm assembly.
Figure 6:
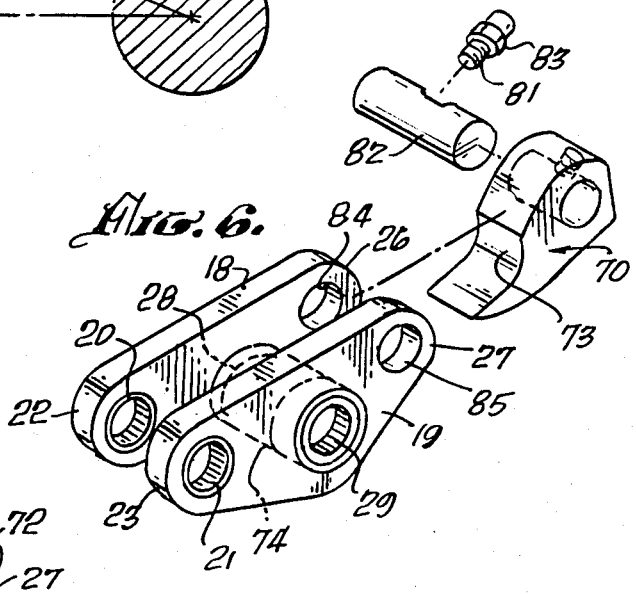
FIG. 6 is a an exploded perspective view of the rocker arm assembly of the valve assembly of FIG. 4.

As seen best in FIG. 3, the pin member 41 slides within the inner surface of shell member 33 as the rocker arm assembly oscillates. The movement of FIG. 3 is exaggerated for illustrative purposes.

Two means for urging the valve into a closed position are shown in the drawings. The first means is shown in FIG. 1 and comprises a helical spring 50 which has an upper end 51 and a lower end 52. Upper end 51 is held securely in a recess 53 in a spring support bar 54. Bar 54 is held by a plurality of bolts 55 and nuts 56 which are, in turn, held by bar 57. Bar 57 may be held to the engine block through a support block (not shown) which, in turn, is bolted to the head. Bar 57 has a cylindrical opening 58 which supports a spring support cup 59. Support cup 59, in turn, supports a stainless steel, threaded pin 60 which terminates in a bearing surface 61. A bearing surface contacts member 62 which holds shaft 63 through a threaded pin 64 held by a jam nut 65. Shaft 63 is held by bearings 24 and 25 in the rocker arm assembly. Member 62 is also threaded to push rod 66 in a conventional manner, and push rod 66 is oscillated by contact with a cam lobe 67 on cam shaft 68. The engine of the present invention, as shown in FIG. 1, has a far quicker valve closing than conventional engines and, thus, is capable of rapid acceleration and sustained high speeds.

Figure 4:
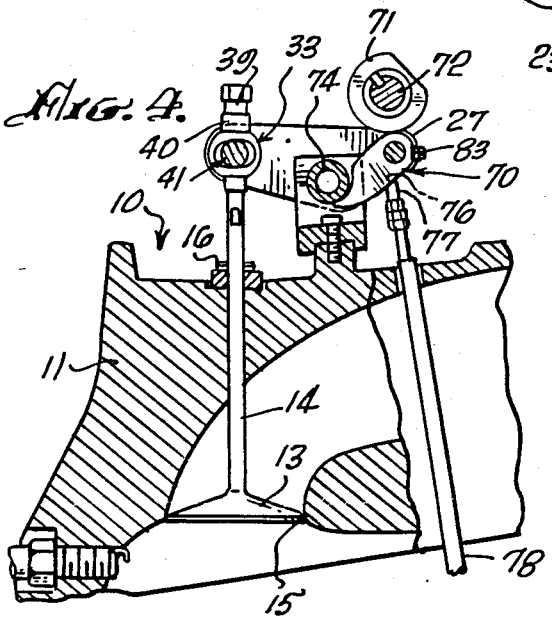
FIG. 4 is a side view partly in cross-section showing an alternate embodiment of the assembly of FIG. 1 having a second cam to force the valve into a closed position.
Figure 5:
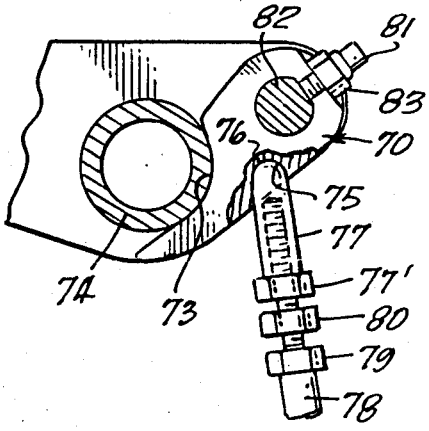
FIG. 5 is an enlarged side view partly in cross-section of the push rod end of the rocker arm assembly of FIG. 4.

An alternate embodiment of the desmodromic engine of the present invention is shown in FIG. 4 where an upper cam lobe 71 is driven by an upper cam shaft 72 and, likewise, contacts push rod support member 70 to drive the second end 27 of the rocker arm assembly downward and thereby quickly close valve 13. Push rod support member 70 has a curved portion 73 which abuts sleeve 74 which, in turn, holds bearings 28 and 29. Support member 70 also has a depression 75 which holds the upper end 76 of push rod threaded cap 77. Cap 77 has a hex portion 78 which assists the turning of cap 77 with respect to push rod 78 which also has a hex portion 79. A jam nut 80 secures cap 77 in place. Also, a set screw 81 holds shaft 82 in place in openings 84 and 85. A jam nut 83 holds set screw 82 in place. It is also possible with the engine of the present invention to provide a large rate of ramping. That is, the distance between bearings 21 and 29 may be twice as much as the distance between bearings 29 and 25. For instance, it has been found that a separation of bearing 21 to 29 may be one and one-half inches while using the separation between bearing 29 and 25 of only three-quarter of an inch. This provides a very large valve opening and yet because of the positive closing still provides a quick valve closing. Thus, the rate of ramping of the rocker arm assembly is very fast in an engine of high rpms, and horsepower may be developed.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An improved internal combustion engine of the desmodromic type having an engine block with cylinders, a head held to the block and a plurality of intake valves and exhaust valves, a pivoted rocker arm assembly having a valve end for each valve and a second end at the opposite end of the rocker arm assembly as the valve end, said rocker arm assembly being attachable to a valve stem at the valve end of the rocker arm assembly, a cam shaft with cam lobes connected to said rocker arm assembly to pivot the rocker arm assembly about its pivot point in a first direction and means to return the rocker arm assembly to its original position, wherein the improvement comprises:

a valve to rocker arm assembly connection including a lower stop on each valve stem;

a shell member having a generally horizontal, hollow inner chamber open at each end, a lower exterior contact surface abutting said lower stop on each valve stem, said shell member having two generally vertically aligned openings through which the valve stem passes, and said shell member having an upper exterior contact surface and an upper and a lower bearing surface on the inner surface thereof;

a generally horizontal pin member held within said shell member having a bearing at each end held near the valve end of a rocker arm assembly and having a generally vertical opening which is larger than the valve stem and surrounding said valve stem, and said pin member having an upper bearing surface adjacent the upper bearing surface of said shell member and a lower bearing surface adjacent the lower bearing surface of said shell member; and means for tightening said valve stem on to the upper exterior contact surface of the shell member to securely hold the shell member onto the valve stem whereby the valve stem can move vertically while the point of connection of the valve stem on the rocker arm assembly moves in an arcuate manner by the sliding of the shell member over the pin member.

2. The improved internal combustion engine of claim 1 further including a sleeve surrounding said valve stem and abutting the upper and lower bearing surfaces of said shell member and passing through the generally vertical opening of said pin member.

3. The improved internal combustion engine of claim 1 wherein the valve end of the rocker arm is driven upwardly by biasing means contacting the rocker arm assembly at a point removed from the valve stem.

4. The improved internal combustion engine of claim 3 wherein said biasing means contacts the rocker arm assembly near its second end, and the rocker arm assembly is pivoted at a point between its point of connection to the valve and its point of contact with said biasing means.

5. The improved internal combustion engine of claim 1 wherein the valve end of the rocker arm assembly is driven up by a rotating cam lobe which contacts said rocker arm assembly at a point removed from the valve stem.

6. The improved internal combustion engine of claim 5 wherein said rotating cam lobe contacts said rocker arm assembly at a point near the second end of the rocker arm assembly.

7. The improved internal combustion engine of claim 1 wherein the upper end of the valve stem is threaded and has a nut which is tightened against the upper exterior contact surface through a cup member.

8. The improved internal combustion engine of claim 7 wherein the stop is a step below the base of the threaded portion of the valve stem and there is a ring between the step and the lower exterior contact surface of the shell member.

9. An improved internal combustion engine of the desmodromic type having an engine block with cylinders, a head held to the block and a plurality of intake valves and exhaust valves, a rocker arm assembly having a valve end for each valve and a second end at the opposite end of the rocker arm assembly as the valve end and a pivot therebetween, said rocker arm assembly being attachable to a valve stem at the valve end of the rocker arm assembly, a cam shaft with cam lobes connected to said rocker arm assembly at its second end to pivot the rocker arm assembly about its pivot point and means to return the rocker arm assembly to its original position, wherein the improvement comprises:

a valve to rocker arm assembly connection including a lower stop on each valve stem;

a shell member having a generally horizontal, hollow inner chamber open at each end, a lower exterior contact surface abutting said lower stop on each valve stem, said shell member having two generally vertically aligned openings through which the valve stem passes, and said shell member having an upper exterior contact surface and an upper and a lower bearing surface on the inner surface thereof;

a generally horizontal pin member held within said shell member having a bearing at each end held near the valve end of a rocker arm assembly and having a generally vertical opening which is larger than the valve stem and surrounding said valve stem and said pin member having an upper bearing surface adjacent the upper bearing surface of said shell member and a lower bearing surface adjacent the lower bearing surface of said shell member;

means for tightening said valve stem on to the upper exterior contact surface of the shell member to securely hold the shell member onto the valve stem whereby the valve stem can move vertically while the point of connection of the valve stem on the rocker arm assembly moves in an arcuate manner by the sliding of the shell member over the pin member; and wherein said means to return the rocker arm assembly to its original position comprises:

a helical spring positioned above said rocker arm assembly near its second end and said spring being compressed by the movement of the rocker arm assembly as the valve opens and urging the second end of the rocker arm assembly in a downward direction to urge said valve into a closed position.

10. The improved internal combustion engine of claim 9 wherein said helical spring has an upper end and a lower end, and the upper end is held by a recess in a first spring support bar held by said engine block, and the lower end of the spring is held in a spring cup surrounded by an opening in a second spring support bar, and said spring cup is connected to the second end of the rocker arm assembly by a contact arm.

11. The improved internal combustion engine of claim 10 wherein the contact arm is about in line with the point of contact between the cam lobe and the second end of the rocker arm assembly.

12. The improved internal combustion engine of claim 11 further including a push rod between said cam lobe and said second end of said rocker arm assembly.

* * * * *